United States Patent [19]

Samejima et al.

[11] Patent Number: 4,915,643

[45] Date of Patent: Apr. 10, 1990

[54] CONNECTOR

[75] Inventors: Masakuni Samejima; Kiyohito Fukuda; Mitsuru Matsumoto, all of Shizuoka, Japan

[73] Assignee: Yazaki Corporation, Japan

[21] Appl. No.: 263,876

[22] Filed: Oct. 28, 1988

[30] Foreign Application Priority Data

Oct. 28, 1987 [JP] Japan ..... 62-164735[U]
Oct. 28, 1987 [JP] Japan ..... 62-164736[U]

[51] Int. Cl.[4] ..... H01R 13/627
[52] U.S. Cl. ..... 439/357; 439/489
[58] Field of Search ..... 439/350–354, 439/357, 358, 488–491, 594, 903

[56] References Cited

U.S. PATENT DOCUMENTS

| | | | |
|---|---|---|---|
| 3,409,858 | 11/1968 | Krehbiel | 439/354 |
| 4,010,998 | 3/1977 | Tolnar et al. | 439/358 |
| 4,214,802 | 7/1980 | Otani et al. | 439/354 |
| 4,272,145 | 6/1981 | La Duke | 439/358 |
| 4,392,706 | 7/1983 | Baker et al. | 439/353 |

OTHER PUBLICATIONS

Japanese Utility Model Laid-open Publication No. 62-15784, 12/7/85.

*Primary Examiner*—David Pirlot
*Attorney, Agent, or Firm*—Wigman & Cohen

[57] ABSTRACT

Disclosed herein is a connector which comprises a female housing and a male housing to be inserted and fitted into the female housing for establishing electrical connection therebetween. A flexible locking arm having a locking aperture is provided on either the male or female housing, and a locking projection is provided on the other housing for generating a restoring force in the locking arm by cambering the locking arm when the male housing is inserted into the female housing. The locking projection engages with the locking aperture by the restoring force in the locking arm when the male and female housings are properly fitted together. The connector further comprises a member provided on the locking arm for producing a fitting-confirmation sound by the restoring force in the locking arm when the locking projection becomes engaged with the locking aperture. According to the connector of this invention, since the fitting-confirmation sound producing member is provided on the locking arm, the weight of the member increases the weight of the locking arm so as to enhance the restoring force. This makes it possible to obtain a larger fitting-confirmation sound than that of the conventional connector. In addition, the connector may include other members for producing fitting-confirmation sounds simultaneous with the production of the first fitting-confirmation sound, whereby it is possible to obtain two or more fitting-confirmation sounds when the male and female housings are properly fitted together.

3 Claims, 5 Drawing Sheets

CONNECTOR

BACKGROUND OF THE INVENTION:

1. Field of the Invention

This invention relates to a connector, and in particular to a connector for connecting wire harnesses that comprises a female housing and a male housing to be fitted to the female housing, in which the connector has a function for confirming the fitting condition by producing a sound when the male housing is properly fitted to the female housing.

2. Description of the Prior Art

In connectors for connecting wire harnesses, it is very important to secure the electrical connection between the male terminals provided in a female housing and the female terminals provided in a male housing when these housings are connected. Therefore, such connectors are required to have a function that makes it easy to confirm a proper fitting between the housings.

As one type of connector having such a function, there is a connector disclosed in Laid Open Publication of Japanese Utility Model application No. 62-15784. As shown in FIG. 1, the connector 1 comprises a female housing 2 and a male housing 3 to be fitted into the female housing 2. The female and male housings 2, 3 include a plurality of terminals therein, respectively. Further, the connector 1 has a locking structure comprising a flexible locking arm 4 provided on the male housing 3 and a locking projection 5 provided on the female housing 2. The flexible locking arm 4 is protrudingly provided on the male connector housing 3. The flexible locking arm 4 has a locking aperture 4*a* therein which locks with the locking projection 5 when the female and male housings 2, 3 are fitted together. Further, behind the locking projection 5, there is provided a sound producing portion 6. The sound producing portion 6 is formed as a raised portion 6 on the female housing 2, against which strikes the flexible locking arm 4 as a result of the restoring force generated in the locking arm 4 when the locking arm 4 rides across the projection 5, whereby a fitting-confirmation sound is produced.

In another type of conventional connector, as shown in FIG. 2, a sound producing portion 7 is formed around the locking projection 5 in order to produce a fitting-confirmation sound.

However, in these conventional connectors, since the sound producing portion is formed on the side of the connector housing, it is not possible to produce a sound sufficiently large enough to confirm a proper fitting between the housings.

SUMMARY OF THE INVENTION

In view of the foregoing problem that exists for conventional connectors, this invention has been made. Accordingly, a main object of the present invention is to provide a connector that produces a large fitting-confirmation sound when the female and male housings are properly fitted together.

Another object of the present invention is to provide a connector capable of producing two fitting-confirmation sounds when the female and male housings are properly fitted together.

In order to accomplish the main object, the connector of the present invention comprises a female housing and a male housing to be inserted and fitted into the female housing for establishing electrical connection therebetween. Provided on the male housing is a flexible locking arm having a locking aperture, and provided on the female housing is a locking projection which generates a restoring force in the locking arm by cambering the locking arm when the male housing is inserted into the female housing. The locking projection then engages with the locking aperture due to the restoring force in the locking arm when the male and female housings are properly fitted together. The connector further comprises means provided on the locking arm for producing a fitting-confirmation sound when the locking projection becomes engaged with the locking aperture.

According to the present invention having the above structure, since the fitting-confirmation sound producing means is provided on the locking arm, the weight of the sound producing means adds to the weight of the locking arm so as to enhance the restoring force, which in turn makes it possible to obtain a larger fitting-confirmation sound than that of conventional connectors. Therefore, it is possible to avoid the occurrence of imperfect fittings which deteriorate the electrical connection in a connector.

Further, in order to attain the second object, the connector of the present invention further comprises a first means provided on the locking arm for producing a first fitting-confirmation sound by when the locking projection and the locking aperture are engaged, and second means for producing a second fitting- confirmation sound which is produced substantially simultaneous with the first fitting-confirmation sound.

According to the connector having the above structure, it is possible to obtain two fitting-confirmation sounds, produced at substantially the same time, when the male and female housings are properly fitted together. Therefore, it is possible to confirm with more certainty whether or not the male housing has been properly fitted to the female housing.

BRIEF DESCRIPTION OF THE DRAWINGS

The objects and advantages of the present invention, as well as the details of the preferred embodiment, will be more fully understood when taken in conjunction with the following drawings, in which.

DETAILED DESCRIPTION OF THE PREFERRED EMBODIMENTS

Figure 3:
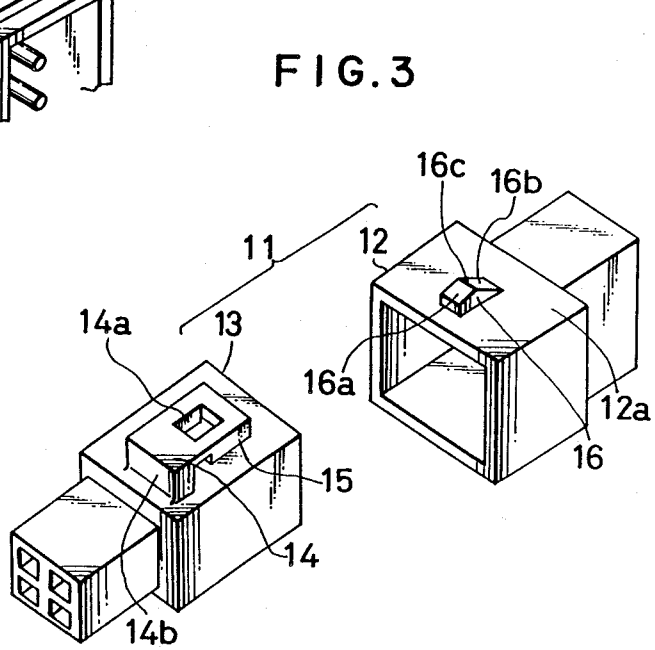
FIG. 3 is a perspective view of the first embodiment of a connector of the present invention.
Figure 2:
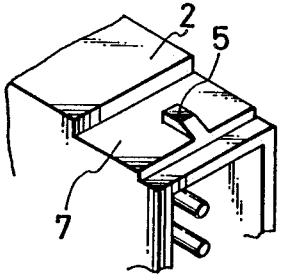
FIG. 2 PRIOR ART
FIG. 2 is a perspective view of the main part of another type of conventional connector.
Figure 1:
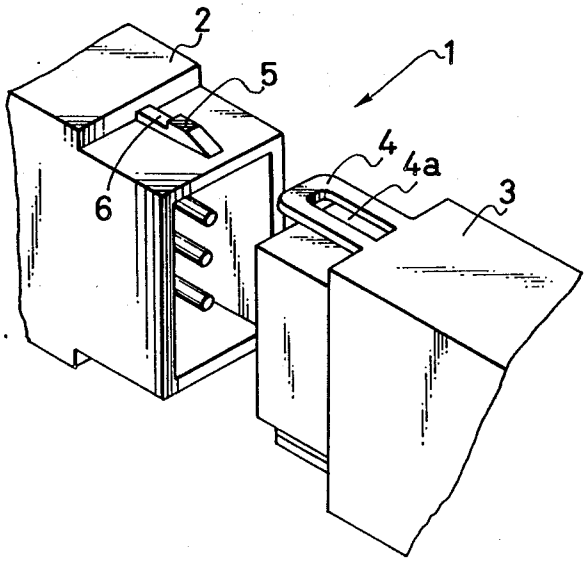
FIG. 1 PRIOR ART
FIG. 1 is a perspective view of a conventional connector having a mechanism that produces a fitting-confirmation sound.

Referring now to the drawings, the preferred embodiments of the present invention will be described.

FIG. 3 shows the first embodiment of a connector of the present invention. In this drawing the reference numeral 11 denotes a connector that comprises a female housing 12 and a male housing 13 to be inserted and fitted into the female housing 12. Accommodated in the female and male housings 12, 13, respectively, are a plurality of male and female terminals (not shown) connected to which wires.

Figure 4:
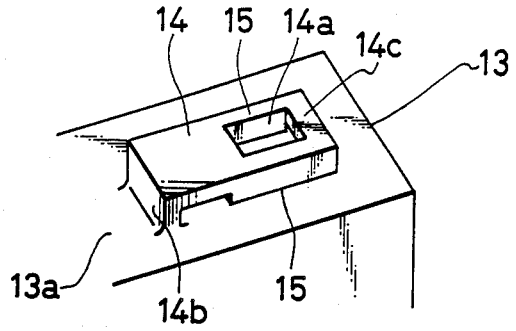
FIG. 4 is a partially enlarged perspective view of a male housing of the first embodiment of the connector.

As is clearly shown in FIG. 4, on the upper surface of the male housing 13, there is provided a flexible locking arm 14 having a locking aperture 14*a*. The locking arm 14 is made from a plate like member formed of a flexible resin material and has a substantially L-shaped configuration having a first side 14*b* and a second side 14*c*. The first side 14*b* of the L-shaped locking arm 14 is fixed onto the upper surface 13*a* of the male housing 13 in such a manner that the second side 14*c* extends in a direction that faces the female housing 12 when the male housing 13 is fitted to the female housing 12. Further, the second side 14*c* is provided so as to be flexibly movable along the vertical direction with respect to the upper surface 13*a* of the male housing 13. On both sides of the front portion of the second side 14*c* of the locking arm 14, respectively, there are integrally formed two sound producing portions 15, represented here as vertical plate portions.

Figure 5:
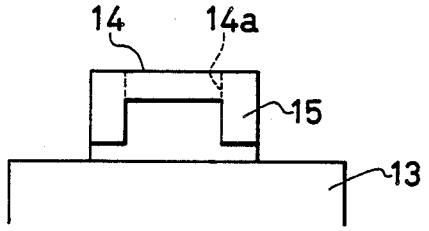
FIG. 5 is a sectional view of the male housing of FIG. 4.

As shown in FIG. 5, the vertical plate portions 15 are provided on the locking arm 14 along the longitudinal direction thereof. As can further be seen in FIG. 5, the vertical plate portions 15 extend downwardly so as to leave a small space between the bottom ends of the vertical plate portions 15 and the upper surface 13*a*, into which the upper surface 12*a* of the female housing 12 is inserted when the female and male housings 12, 13 are fitted together.

Figure 6:
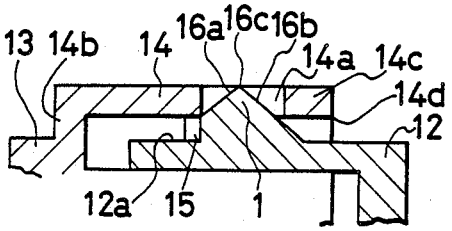
FIG. 6 is a front view of the male housing of FIG. 4.

On the upper surface 12*a* of the female housing 12, there is formed a locking projection 16 to be engaged with the locking aperture 14*a* of the locking arm 14 when the female and male housings 12, 13 are fitted together. The locking projection 16 has a substantially rectangular shape in cross section taken along the insertion direction of the male housing 13 to the female housing 12. As shown in FIGS. 3 and 6, the locking projection 16 has a first inclined surface 16*a* that declines toward the front side of the female housing 12 and a second inclined surface 16*b* that declines toward the rear side of the female housing 12. The width of the locking projection 16 is slightly smaller than the width of the aperture 14*a* located between the vertical plate portions 15. As shown in FIG. 6, the peak 16*c* of the projection 16, which is formed between the first and second surfaces 16*a* and 16*b*, has a height such that the peak 16*c* resides in the locking aperture 14*a* of the locking arm 14 when the female and male housings 12, 13 are fitted together. However, it is preferable that the height of the peak 16*c* be higher than the upper surface of the locking arm 14.

When the male housing 13 is fitted into the female housing 12, the front edge 14*d* of the locking arm is first abutted against the first surface 16*a* of the projection 16. In accordance with the insertion of the male housing 13, the locking arm 14 is cambered, thereby generating a restoring force in the locking arm 14, and when the front edge 14*d* reaches the peak 16*c* of the projection 16, this restoring force reaches its maximum value. Then, when the peak 16*c* of the projection 16 reaches the locking aperture 14*a* of the locking arm 14, the locking arm 14 is suddenly lowered due to the restoring force in the locking arm 14, so that the locking projection 16 becomes engaged with the locking aperture 14*a* of the locking arm 14. As a result, simultaneously with the proper engagement therebetween, the vertical plate portions 15 of the locking arm 14 strike the upper surface 12*a* of the female housing 12 due to the restoring force in the locking arm 14, which thus emits a fitting-confirmation sound.

In this case, please note that the striking force of the locking arm 14 is relatively increased with respect to conventional connectors due to the extra weight of the vertical plate portions 15 provided on the second side 14*c* of the locking arm 14. Furthermore, the front portion of the locking arm 14 where the vertical plate portions 15 are provided is not cambered because the front portion is reinforced by the vertical plate portions 15. Specifically, according to this embodiment, since the restoring force is generated only in the remaining rear portion of the locking arm 14, namely the first side 14*b* of the locking arm 14 and the second side 14*c* not including the front portion that is reinforced by the vertical plate portions 15, the restoring force in the locking arm 14 becomes larger than that in the locking arms of conventional connectors which do not have reinforcing members such as the vertical plate portions 15. It thus becomes possible to obtain a larger fitting- confirmation sound than that for conventional connectors. Furthermore, in this case, because the vertical plate portions 15 are tightly abutted on the upper surface 12*a* of the female housing 12, displacement between the female and male housings 12, 13 can also be prevented.

Figure 7:
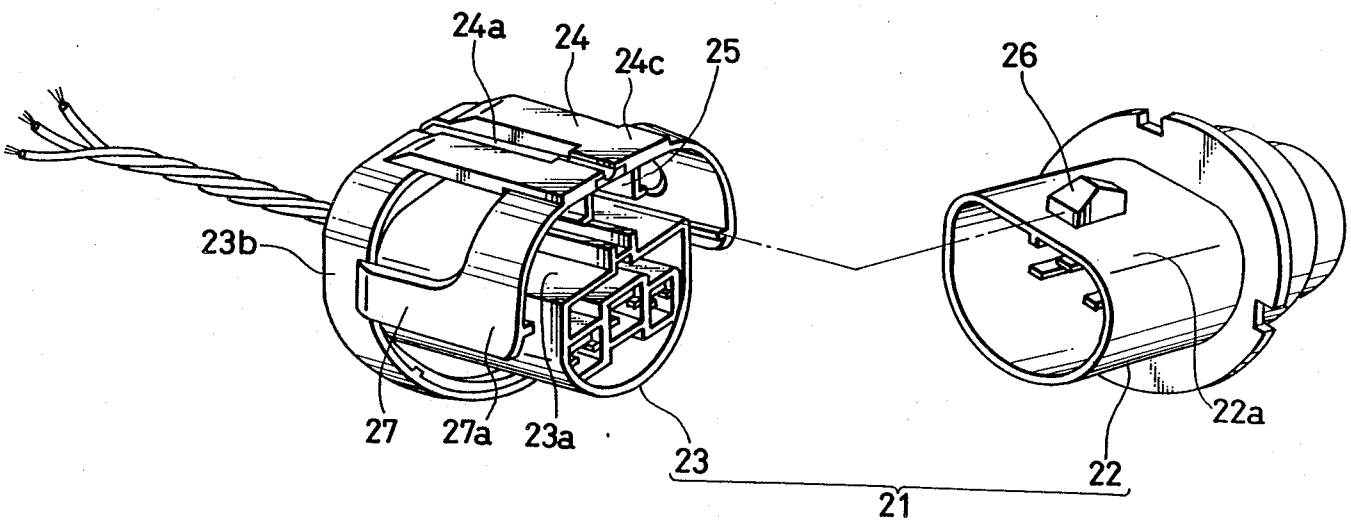
FIG. 7 is a perspective view of the second embodiment of a connector of the present invention.

FIG. 7 shows the second embodiment of the present invention. In the drawing, the numeral 21 denotes a connector for use with a socket for an electric light bulb.

The connector 21 comprises a female housing 22 and a male housing 23 to be inserted and fitted into the female housing 22. On the male housing 23, there is provided a locking arm 24 having a substantially C-shaped configuration. The locking arm 24 is provided on the rear portion 23*b* of the male housing 23 so as to protrude toward the insertion direction of the male housing 23 to the female housing 22. The locking arm 24 is also made of a flexible material so that the front portion 24*c* of the locking arm 24 is flexibly movable in the vertical direction with respect to the upper surface of the male housing 23. Further, in the locking arm 24, there is formed a locking aperture 24*a*.

Further, on the underside surface of the tip portion 24*c* of the locking arm 24, there are provided a pair of sound producing portions 25, shown in FIG. 7 as vertical plates, that are integrally formed on the locking arm 24 along the longitudinal direction thereof. The sound producing portions 25 extend downwardly so as to leave a small space between the bottom end sections of the sound producing portions 25 and the upper surface 23*a* of the male housing 23, into which is inserted the upper surface 22*a* of the female housing 22 when the female and male housings 22, 23 are fitted together. As shown in FIG. 7, the bottom end sections of the sound producing portions 25 are bent outwardly, respectively.

On the upper surface 22*a* of the female housing 22, there is formed a locking projection 26 to be engaged with the locking aperture 24*a* of the locking arm 24 when the female and male housings 22, 23 are fitted together. The structure and the size of the locking projection 26 are substantially the same as that for the first embodiment. In this case, it is preferable that the female housing be formed from a hard material such as a composition of vitreous material and polyphenylenesulfide (PPS), or the like.

Further, in this embodiment, there are provided on the male housing 23 two L-shaped arm members 27 for disengaging with ease the locking arm 24 from the locking projection 26. Each of the L-shaped arm members 27 is coupled between the front portion 24*c* of the locking arm 24 and the rear portion 23*b* of the male housing 23. Therefore, if the corner angle portions 27*a* of the L-shaped arm members 27 are pushed inwardly from both sides of the male housing 23, the front portion 24*c* of the locking arm 24 is lifted, thus disengaging the locking projection 26 from the locking aperture 24*a*.

The fitting conditions of the female and male housings 22, 23 and the mechanism for producing the fitting confirmation sound are substantially the same as those for the first embodiment, so any further detailed descriptions are believed to be unnecessary. However, please note that if the female housing 22 is formed from hard materials, as stated above, it becomes possible to change the tone quality of the sound. Namely, it becomes possible to obtain, for example, a metallic sound, which may be more audible than other types of sounds.

Figure 8:
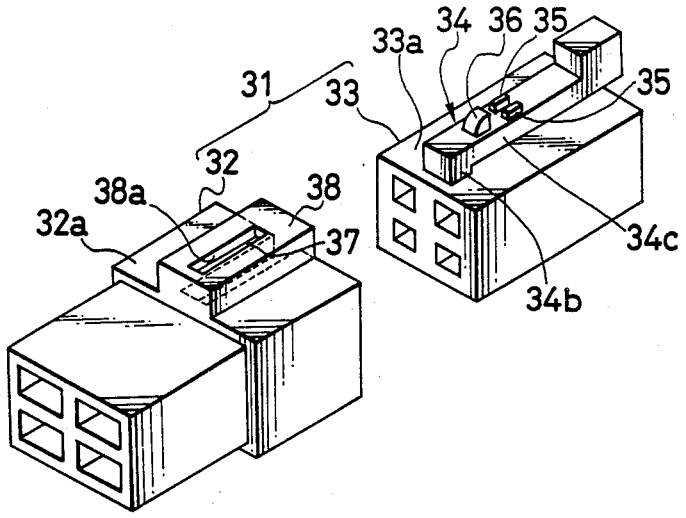
FIG. 8 is a perspective view of the third embodiment of a connector of the present invention.

FIG. 8 shows the third embodiment of a connector of the present invention.

The connector 31 comprises a female housing 32 and a male housing 33 to be inserted and fitted into the female housing 32. On the upper surface 33*a* of the male housing 33 there is provided a locking arm 34. The locking arm 34 is formed from a substantially L-shaped plate member made of a flexible resin material, which has a first portion 34*b* and a second portion 34*c*. The first portion 34*b* of the L-shaped locking arm 34 is fixed onto the upper surface 33*a* at the front part of the male housing 33 in such a manner that the second portion 34*c* extends toward the rear part of the male housing 33 along the longitudinal direction thereof. Therefore, the second portion 34*c* is flexibly movable along the vertical direction with respect to the upper surface 33*a* of the male housing 33.

On the upper surface of the second portion 34*c* of the locking arm 34, there is provided a locking projection 36 having a triangular shape in cross section; namely, the locking projection has an inclined surface and a vertical surface. In addition, behind the locking projection 36 on the upper surface of the locking arm 34 there are provided a pair of sound producing portions 35 formed as two protrusions.

On the upper surface 32*a* of the female housing 32, there is formed a longitudinal slit 37 into which the locking arm 34 is passed when the male housing 33 is inserted into the female housing 32. On the upper surface 32*a* of the female housing 32, a locking cover 38 formed from a half-cup-shaped member is integrally provided so as to surround the slit 37. On the upper surface of the locking cover 38, there is formed a locking aperture 38*a* with which the locking projection 36 is engaged when the female and male housings 32, 33 are properly fitted together.

According to the embodiment having the above structure, when the male housing 33 is inserted into the female housing 32 in such a manner that the locking arm 34 passes into the slit 37, the locking projection 36 is first abutted on a front edge of the locking cover 38. Then, as the male housing 33 is further inserted into the female housing 32, the second portion 34*c* of the locking arm 34 is lowered due to the abutment between the first inclined surface of the projection 36 and the front edge of the locking cover 38, which thus generates a restoring force in the locking arm 34. When the locking arm 34 reaches the locking aperture 38*a* of the locking cover 38, the locking arm 34 is suddenly lifted by the restoring force and the projection 36 is then engaged with the locking aperture 38*a*, whereby a proper fitting between the female and male connectors 32, 33 is attained. In this case, simultaneously as the locking projection 36 becomes engaged with the locking aperture 38*a*, the protrusions 35 strike the underside of the locking cover 38, thus producing a fitting-confirmation sound.

Figure 9:
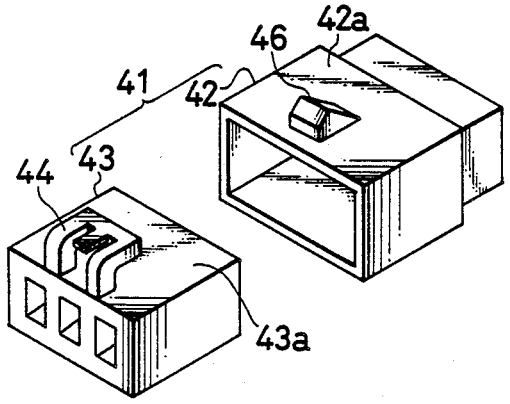
FIG. 9 is a perspective view of the fourth embodiment of a connector of the present invention.

FIG. 9 shows the fourth embodiment of the present invention.

Figure 10:
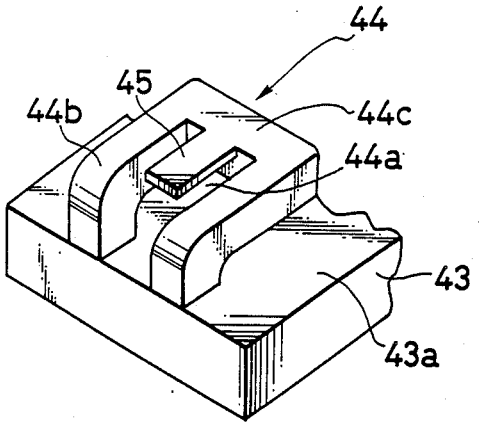
FIG. 10 is a partial perspective view of the main part of a male housing of a connector of the present invention.

The connector 41 comprises a female housing 42 and a male housing 43 to be inserted and fitted into the female housing 42. On the upper surface 43*a* of the male housing 43, as is clearly shown in FIG. 10, there is provided a substantially C-shaped locking arm 44. The C-shaped locking arm 44 comprises two leg portions 44*b* and a locking portion 44*c* provided between the leg portions 44*b*. Each leg portion 44*b* has a substantially L-shaped configuration having a first end and a second end, with the locking portion 44*c* being integrally formed between the first ends of the leg portions 44*b*. The second ends of the leg portions 44*b* of the locking arm 44 are attached onto the rear part of the upper surface 43*a* in such a manner that the first ends extend toward the front part thereof, so that the locking arm 44 is flexibly supported on the male housing 43. Further, a locking aperture 44*a* is formed by the leg portions 44*b* and the locking portion 44*c*. In addition, on the rear side of the locking portion 44*c*, there is integrally formed a sound producing portion 45 which protrudes into the locking aperture 44*a*. In this embodiment, the sound producing portion 45 is formed from a thin plate-like member.

On the upper surface 42*a* of the female housing 42, there is formed a locking projection 46 to be engaged with the locking aperture 44*a* of the locking arm 44 when the female and male housings 42, 43 are fitted together. The structure and the size of the locking projection 46 are substantially the same as those for first and second embodiments.

Figure 11A:
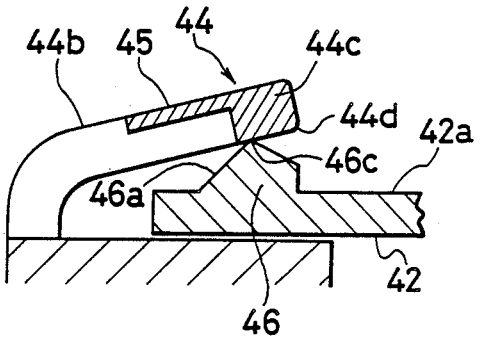
FIGS. 11(A) and 11(B) are explanatory drawings showing locking conditions of the female and male housings of the connector of FIG. 9.
Figure 11B:
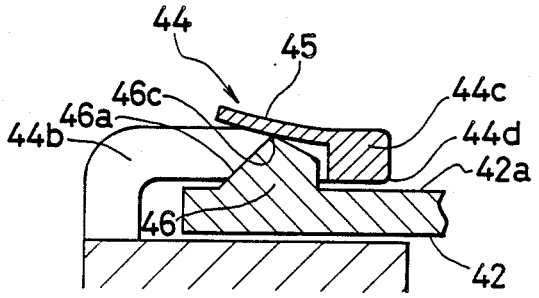

When the male housing 43 is fitted into the female housing 42, a front edge 44*d* of the locking arm 44 is first abutted against a first inclined surface 46*a* of the projection 46. In accordance with the insertion of the male housing 43, the locking arm 44 is cambered due to the abutment between the first inclined surface 46*a* and the front edge 44*d*, thereby generating restoring force in the locking arm 44. When the underside surface of the locking portion 44*c* reaches the peak 46*c* of the projection 46, this restoring force reaches its maximum value, and this condition is shown in FIG. 11A. Then, when the peak 46*c* of the projection 46 reaches the locking aperture 44*a* of the locking arm 44, the locking arm 44 is suddenly lowered due to the restoring force in the locking arm 44, so that the locking projection 46 becomes engaged with the locking aperture 44*a* of the locking arm 44. Simultaneously, the underside surface of the locking portion 44*c* of the locking arm 44 strikes the upper surface 42*a* of the female housing 42 due to the restoring force, which thus emits a first fitting- confirmation sound. In addition to this, as shown in FIG. 11B, the sound producing portion 45 of the locking arm 44 strikes the locking projection 46, which thus emits a second fitting-confirmation sound at substantially the same time the first fitting-confirmation is emitted.

As stated above, in accordance with this embodiment, it is possible to obtain two fitting-confirmation sounds, produced at substantially the same time, when the male and female housings are properly fitted together.

It should be noted that it is possible to incorporate the mechanism for generating the second fitting-confirmation sound of this embodiment into the connectors of the first and second embodiments.

In these embodiments, the sound producing portions may be formed from different materials than that of the locking arm in order to improve the tone quality of the fitting-confirmation sound.

Further, it is also preferable to increase the height of the projection as much as possible in order to generate a large restoring force in the locking arm.

Furthermore, it is also preferable to make the striking area of the sound producing portion large in order to generate a loud fitting-confirmation sound.

Finally, it must be understood that the invention is in no way limited to the above embodiments and that many changes may be brought about therein without departing from the scope of the invention as defined by the appended claims.

What is claimed is:

1. A connector, comprising:

a female housing having an upper surface;

a male housing to be inserted and fitted into said female housing for establishing electrical connection therebetween, the male housing having an upper surface;

a flexible locking arm having a locking aperture, said locking arm provided on the upper surface of said male housing so as to be flexibly supported thereon, said flexible locking arm having a tip portion and two sides;

a locking projection provided on the upper surface of said male housing, said locking projection generating a restoring force in said locking arm by cambering said locking arm when said male housing is inserted into said female housing, and said locking projection being engaged with said locking aperture by the restoring force when said male and female housings are properly fitted together; and means for producing a fitting-confirmation sound by said restoring force when said locking projection is engaged with said locking aperture, said fitting confirmation sound producing means comprising a pair of vertical plates provided on both sides of the tip portion of said locking arm, respectively, along the longitudinal direction of the locking arm in order to reinforce the tip portion of the locking arm, and the vertical plates being adapted to strike the upper surface of said female housing to produce the sound by the restoring force when said male and female housings are properly fitted, whereby the restoring force is generated only in the non-reinforced portion of said locking arm to increase the restoring force.

2. A connector as claimed in claim 1, wherein said female housing is formed from a material harder than that of said sound producing member so as to improve the tone quality of the fitting-confirmation sound.

3. A connector as claimed in claim 2, wherein said female housing is formed from a composition of vitreous material and PPS.

* * * * *